US006668897B2

(12) United States Patent
Gunn

(10) Patent No.: US 6,668,897 B2
(45) Date of Patent: Dec. 30, 2003

(54) TAPE AND JOINT COMPOUND DISPENSER FOR TAPING DRYWALL JOINTS

(76) Inventor: David T. Gunn, 30043 Hilltop Dr., Evergreen, CO (US) 80439

( * ) Notice: Subject to any disclaimer, the term of this patent is extended or adjusted under 35 U.S.C. 154(b) by 0 days.

(21) Appl. No.: 10/222,948

(22) Filed: Aug. 16, 2002

(65) Prior Publication Data

US 2003/0066611 A1 Apr. 10, 2003

Related U.S. Application Data

(60) Provisional application No. 60/312,917, filed on Aug. 16, 2001.

(51) Int. Cl.[7] ..... B44C 7/02

(52) U.S. Cl. ..... 156/577; 156/71; 156/574; 156/579

(58) Field of Search ..... 156/574, 577, 156/579, 71

(56) References Cited

U.S. PATENT DOCUMENTS

| | | | | | |
|---|---|---|---|---|---|
| 2,191,238 | A | * | 2/1940 | Rasanen | 156/494 |
| 2,366,674 | A | * | 1/1945 | Petty | 156/71 |
| 3,707,427 | A | * | 12/1972 | Erickson | 156/575 |
| 5,114,527 | A | * | 5/1992 | Stern et al. | 156/575 |
| 5,545,287 | A | * | 8/1996 | Carlson | 156/575 |
| 6,367,534 | B1 | * | 4/2002 | McGlenn | 156/575 |

* cited by examiner

*Primary Examiner*—Mark A. Osele
(74) *Attorney, Agent, or Firm*—Ralph F. Crandell

(57) ABSTRACT

A tape and joint compound dispenser is formed by a housing defining an interior chamber for receiving joint compound and joint tape. A valved port in the housing opens into the chamber for supplying joint compound. A tape lifter in the chamber enables the user to lift the tape in the chamber to facilitate supplying joint compound to the chamber through the port and below the tape.

20 Claims, 12 Drawing Sheets

TAPE AND JOINT COMPOUND DISPENSER FOR TAPING DRYWALL JOINTS

CROSS REFERENCE TO RELATED APPLICATION

This application claims the benefit of Provisional application Ser. No. 60/312,917, filed Aug. 16, 2001, for Tape and Joint Compound Dispenser for Taping Drywall Joints.

BACKGROUND OF THE INVENTION

1. Field of the Invention

The invention relates to a drywall or wallboard tape and joint compound dispenser or taping gun. More specifically, the present invention relates to a taping tool or taper for use in applying tape and joint compound to drywall or wallboard joints.

2. Description of the Prior Art

Taping tools or applicators have been in use in the drywall installation industry for many years. One manufacturer of such a device is Wallboard Tool Co., Inc. of Long Beach Calif., which has since as early as 1994, sold a product identified as the "Wal-Board 'Quick-Load' Drywall Taper." The Wal-Board taper has a box or housing defining an interior chamber containing drywall joint compound. Drywall joint tape from a roll supply carried on the box is passed through the chamber in which it receives a coating of joint compound. The coated tape is then applied to a wallboard or drywall joint. The tool is refilled with the joint compound when necessary by opening the box cover, using both hands to lift the wet tape carefully away from the bottom of the chamber, and then adding a supply of joint compound to the chamber between the tape and the bottom of the chamber.

A self-loading drywall tape applicator is shown in U.S. Pat. No. 3,707,427. Drywall joint compound is supplied by a pump from a hopper to the joint compound chamber of the tool through which drywall tape is passed for the application of joint compound thereto and the subsequent application of the coated tape to a drywall joint.

SUMMARY OF THE INVENTION

The present invention is embodied in a tape gun for applying joint tape and joint compound to drywall joints. The taper is formed by a housing having opposed side walls spaced apart a width determined by the width of the drywall tape being applied, and peripheral top, bottom, and end walls. The housing defines therein a chamber for holding joint compound for application to the tape. The housing further defines an entrance slot in one end wall opening into the chamber for receiving tape for the application of joint compound thereto, and an exit slot for supplying tape with joint compound thereon to the drywall joint. The chamber has an upper arcuate top wall and a lower elongated bottom wall.

A tape lifter is swingably mounted in the housing chamber and extends into the chamber between the tape entrance slot and the tape exit slot. When the tape gun is in use, the lifter is positioned adjacent the lower chamber wall with the tape positioned between the lifter and the upper chamber wall.

For actuating the tape lifter, a handle is swingably mounted exteriorly on the housing and is operatively connected to the tape lifter for swinging the lifter to lift the tape and position it against the upper wall of the chamber. The handle retracts the lifter to position the same adjacent the bottom wall of the chamber.

The housing further defines in one wall a valved port through which joint compound is introduced into the chamber below the lifted tape. In this manner, joint compound can be supplied to the chamber through the port and below the tape for subsequent application to the tape as the tape passes through the slots for application to drywall joints.

DESCRIPTION OF THE INVENTION

Figure 1:
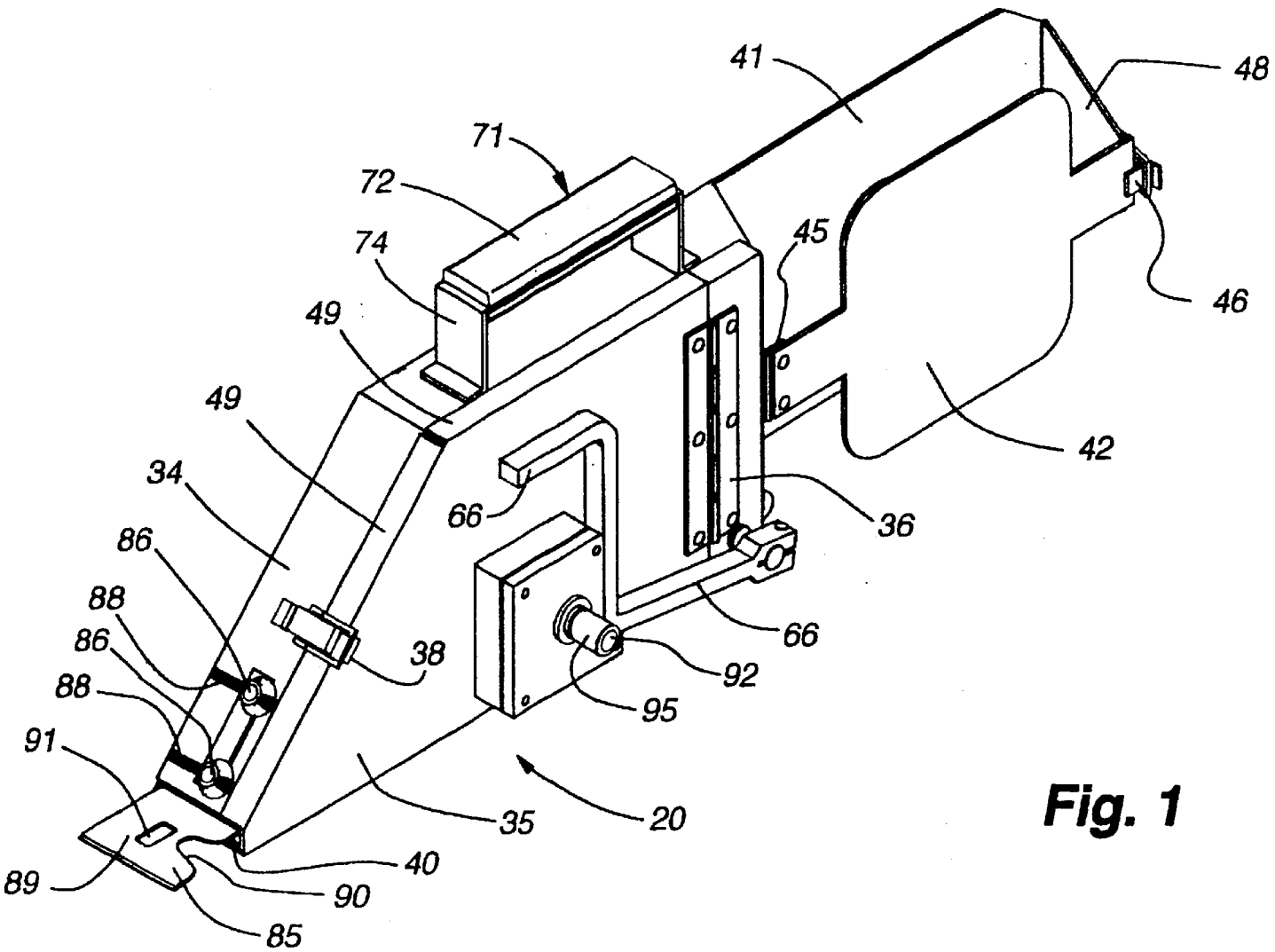
FIG. 1 is a left front perspective view of the tape and joint compound dispenser embodying the present invention.
Figure 2:
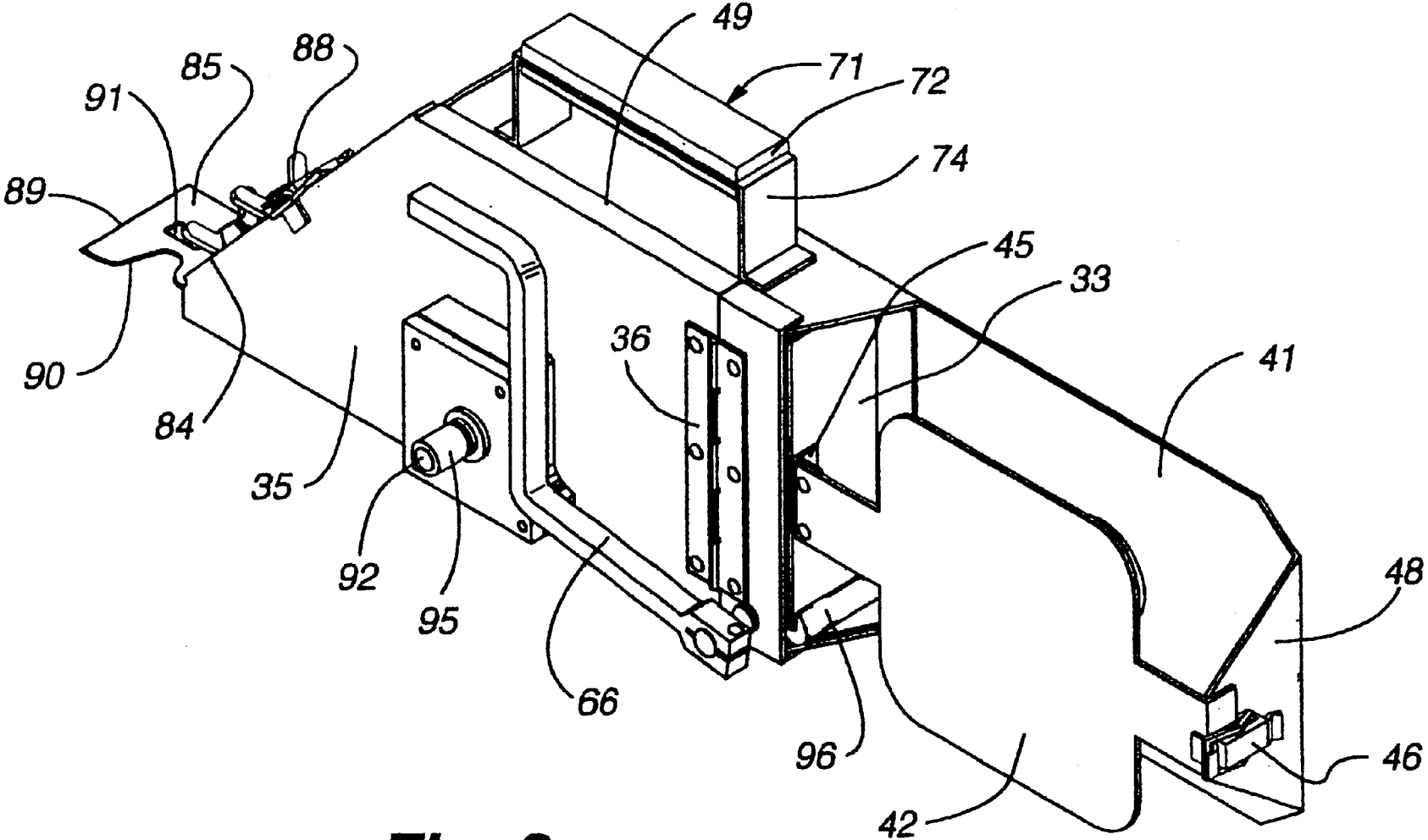
FIG. 2 is a right front perspective view thereof.
Figure 3:
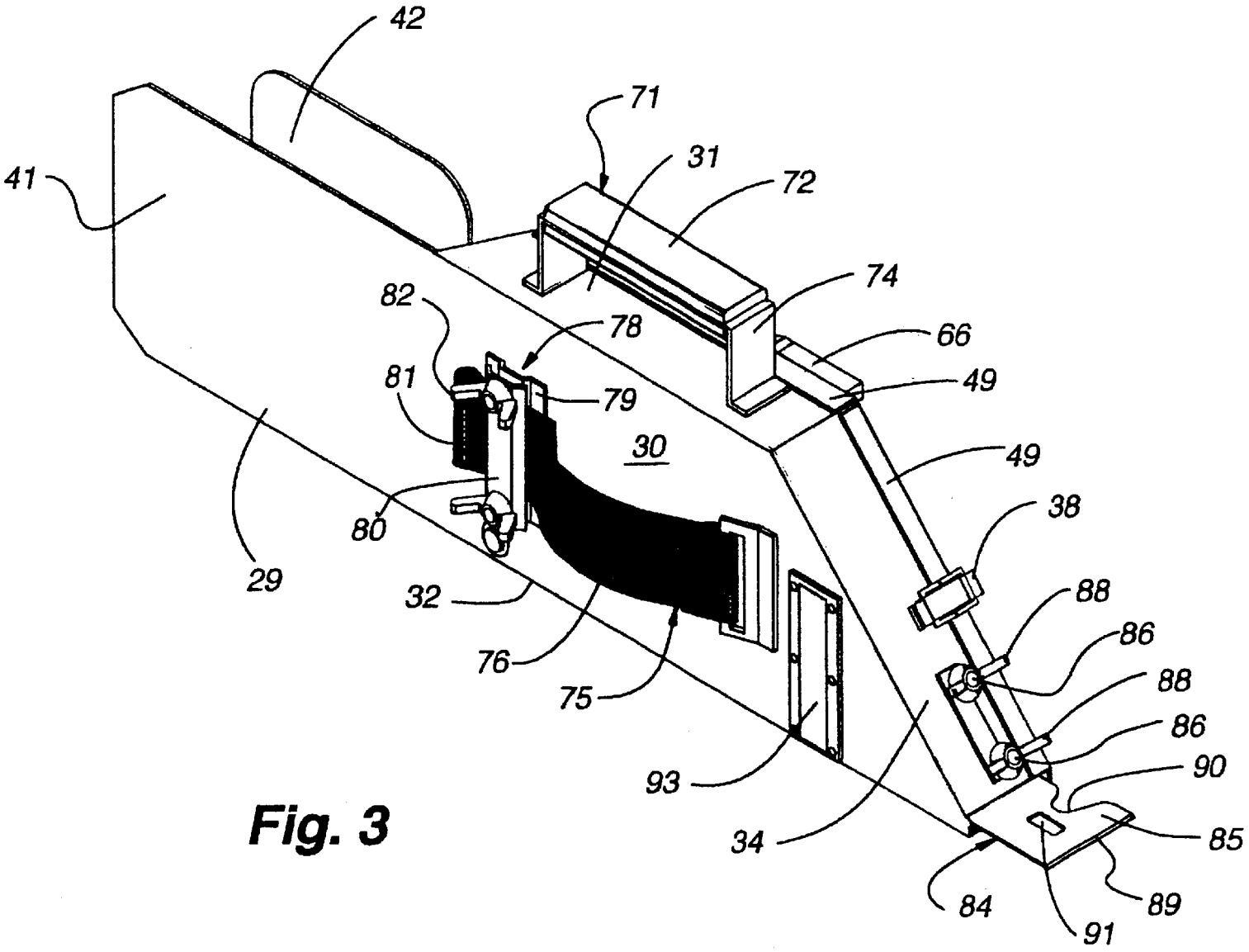
FIG. 3 is a right rear perspective view thereof.
Figure 4:
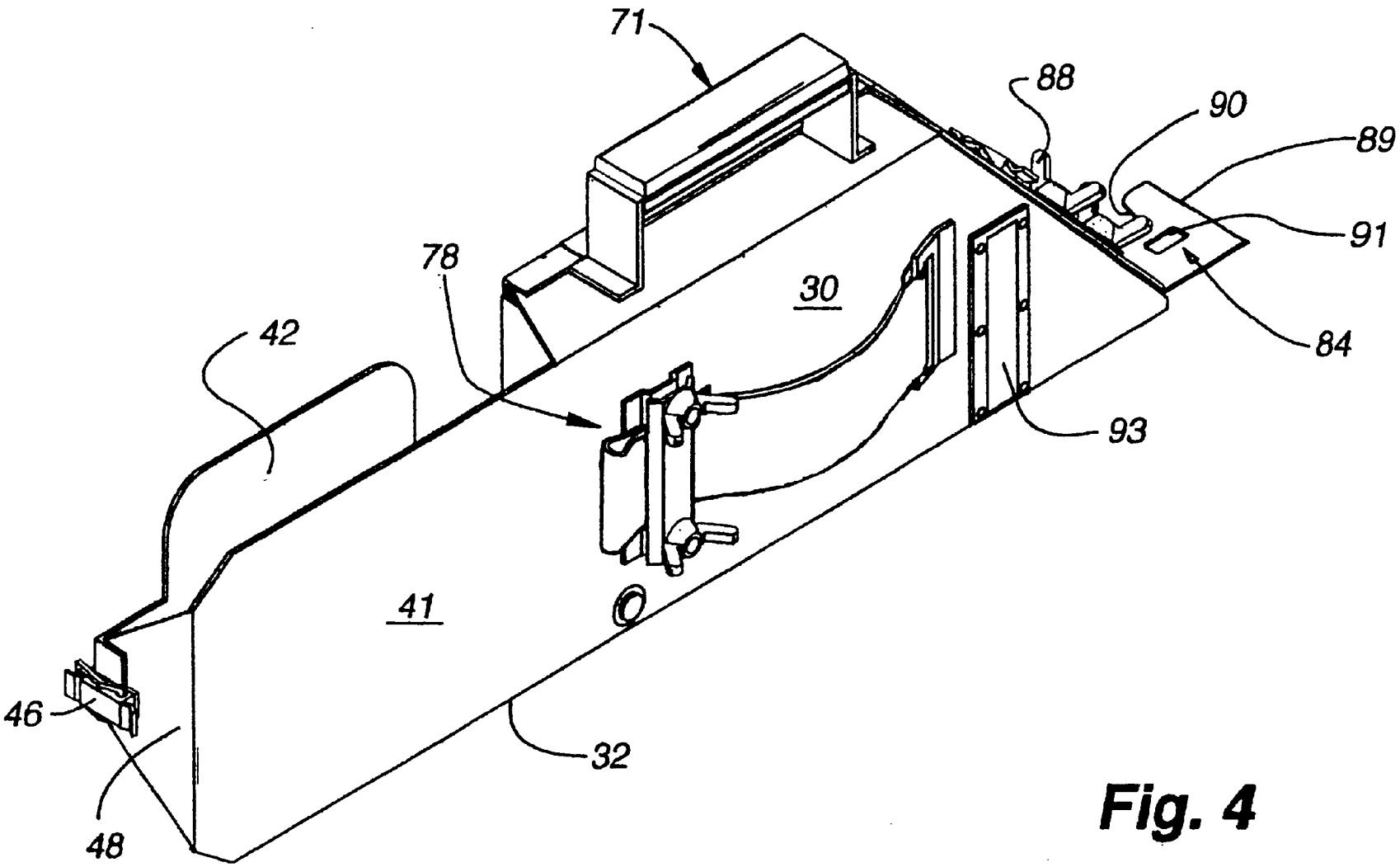
FIG. 4 is a left rear perspective view thereof.
Figure 5:
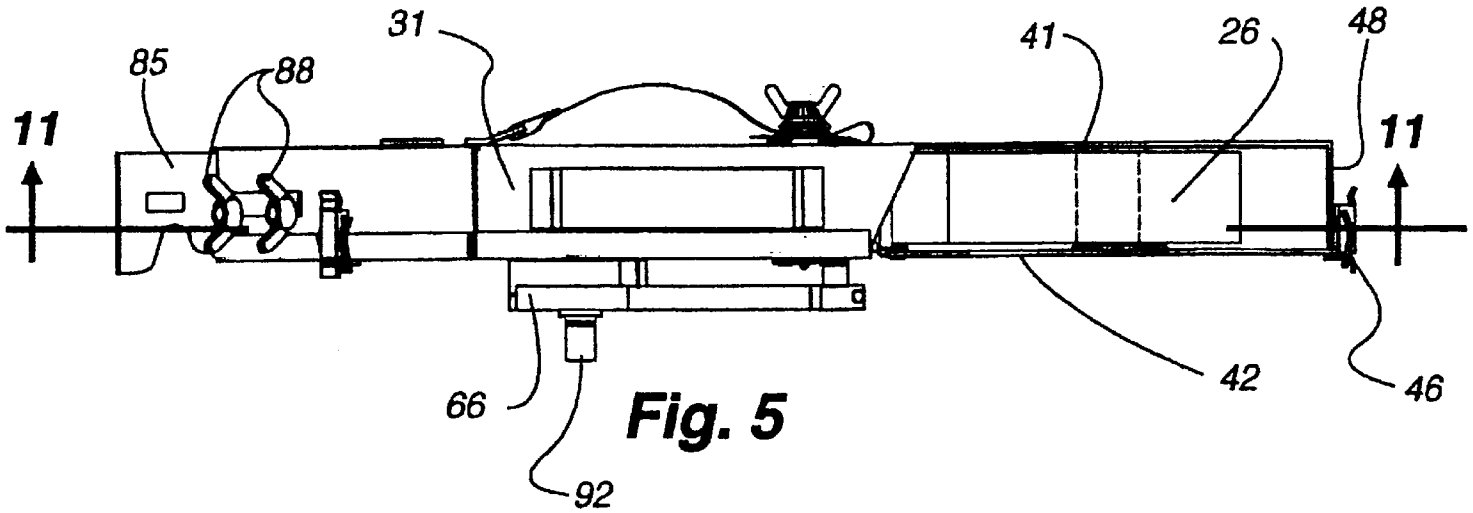
FIG. 5 is a top plan view thereof.
Figure 7:
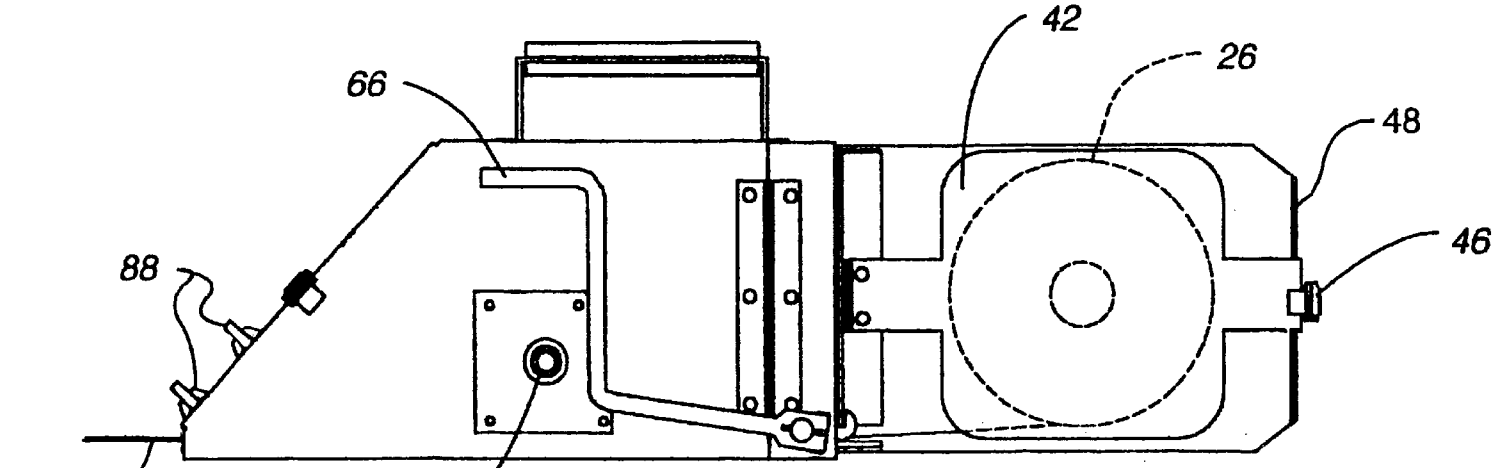
FIG. 7 is a front elevation view thereof.
Figure 6:
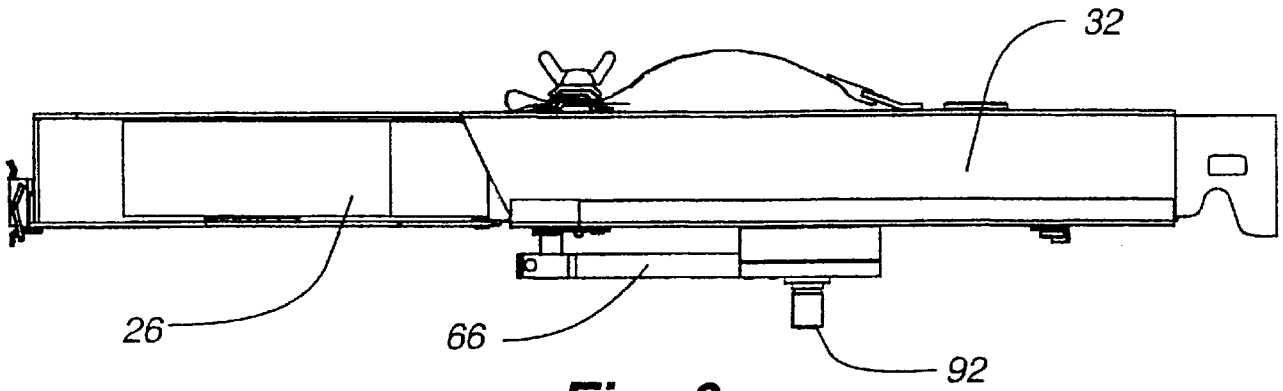
FIG. 6 is a bottom plan view thereof.
Figure 8:
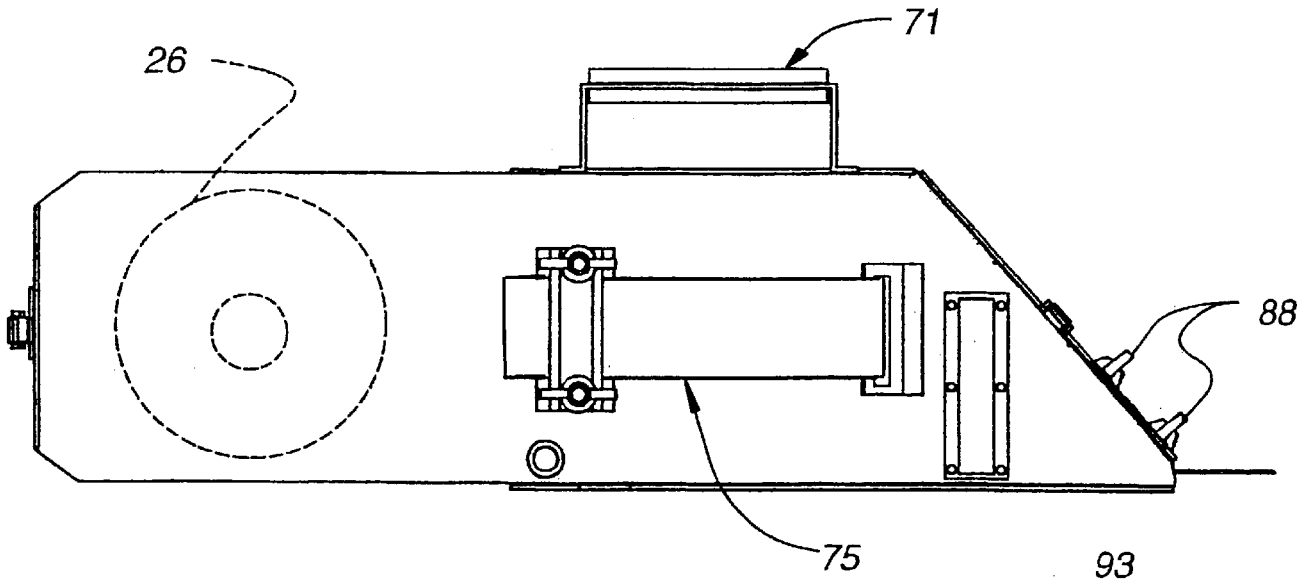
FIG. 8 is a rear elevation view thereof.
Figure 10:
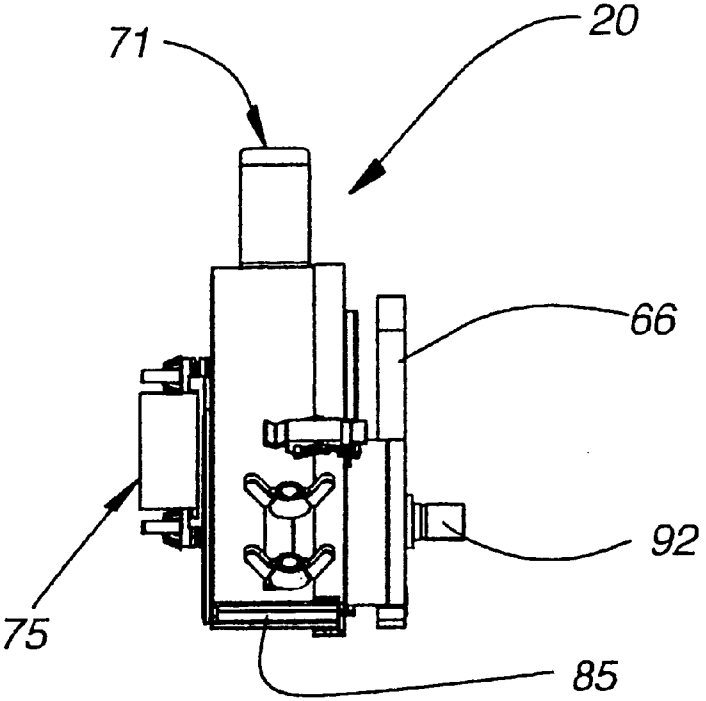
FIG. 10 is a left end view thereof.
Figure 9:
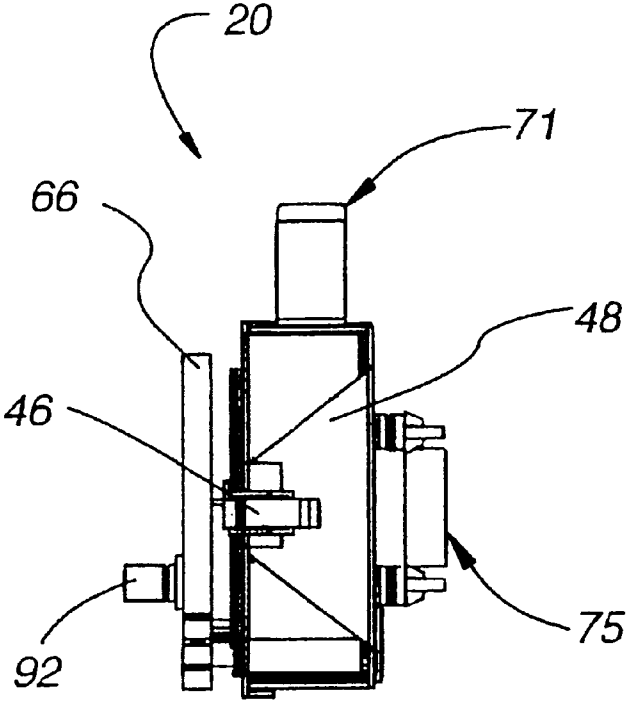
FIG. 9 is a right end view thereof.
Figure 11:
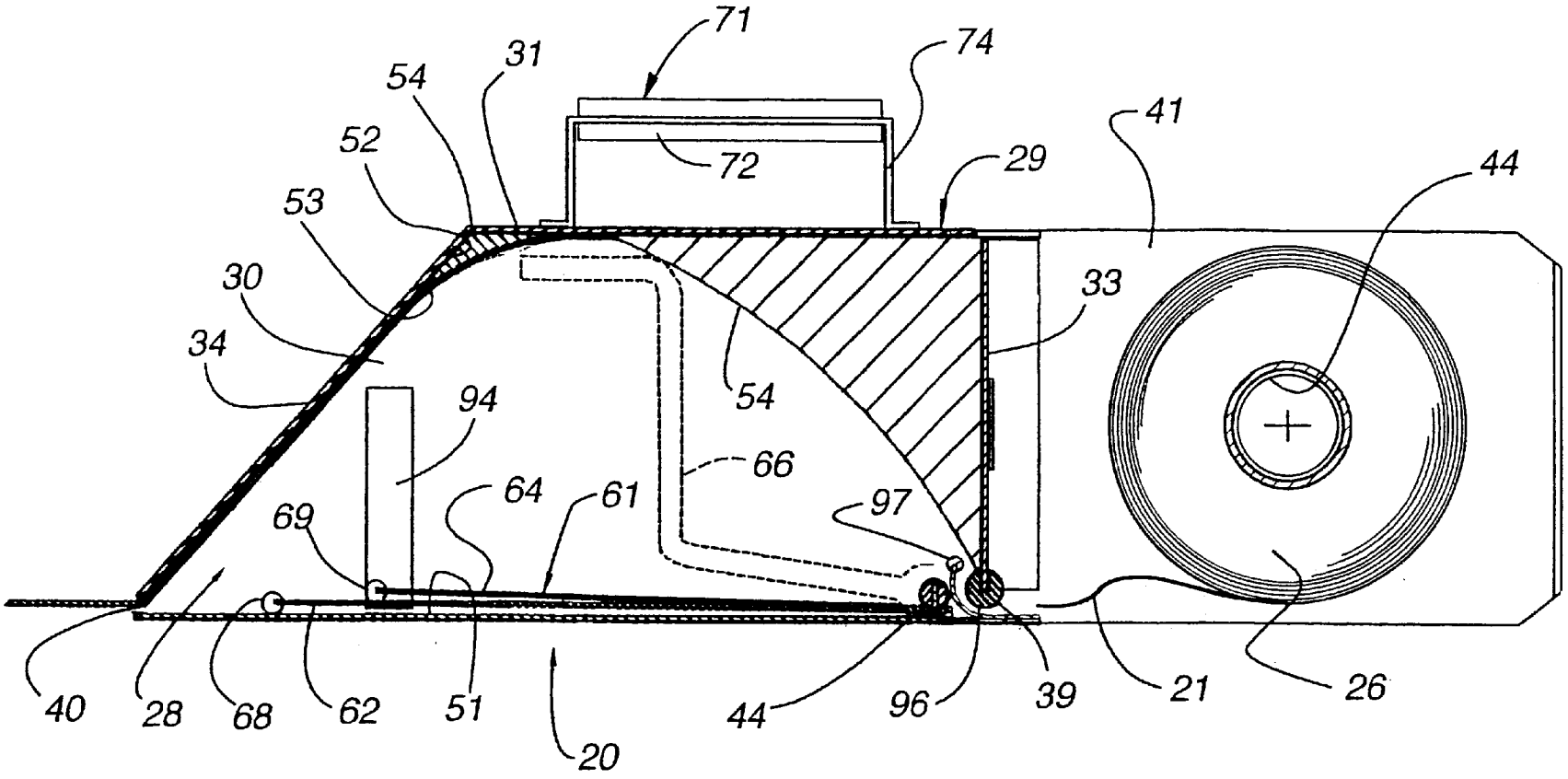
FIG. 11 is a section view taken substantially in the plane of line 11—11 on FIG. 5 and showing the lifter in retracted position.
Figure 12:
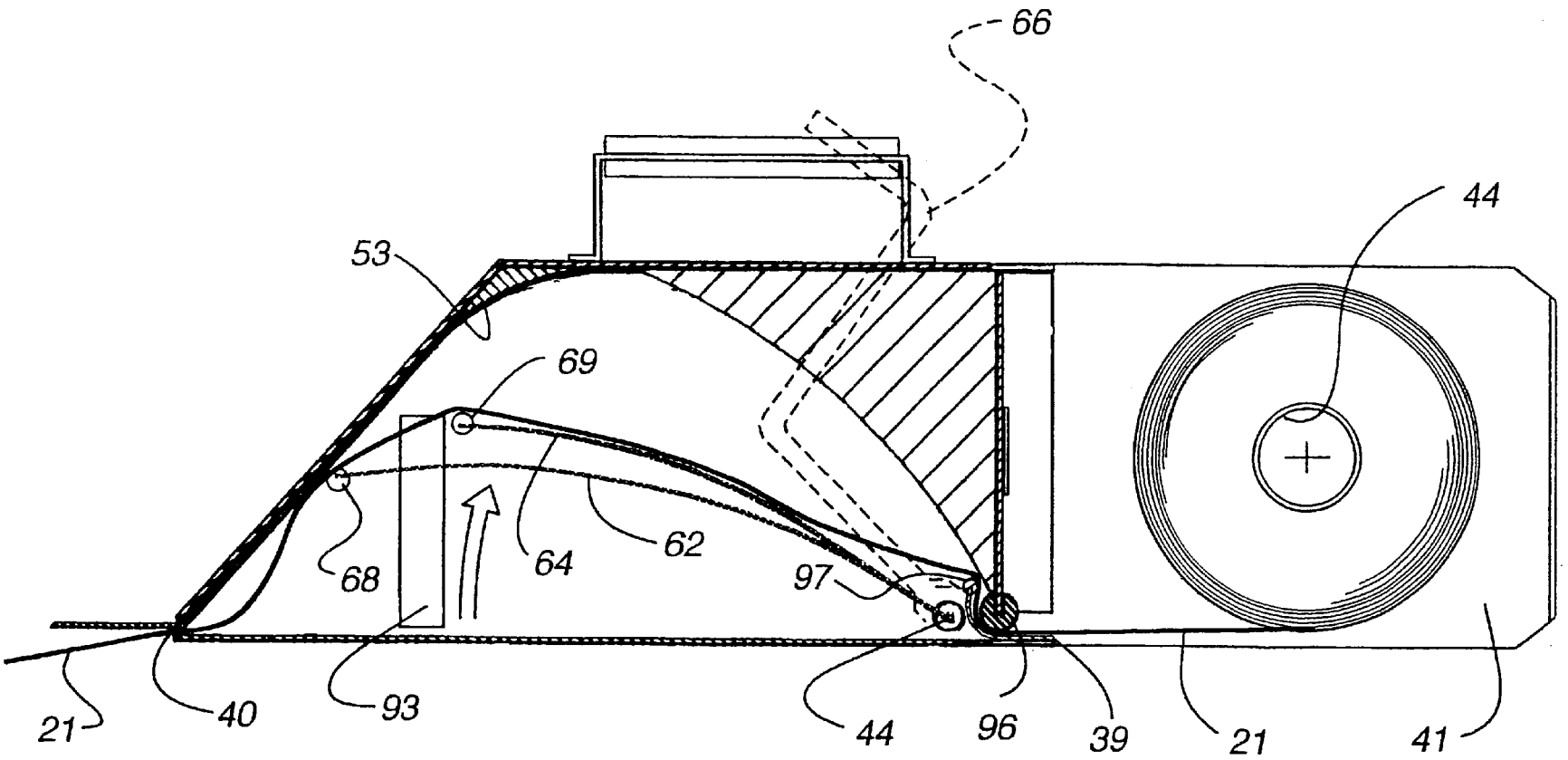
FIG. 12 is a view similar to FIG. 11 but showing the lifter in a partially raised position.
Figure 13:
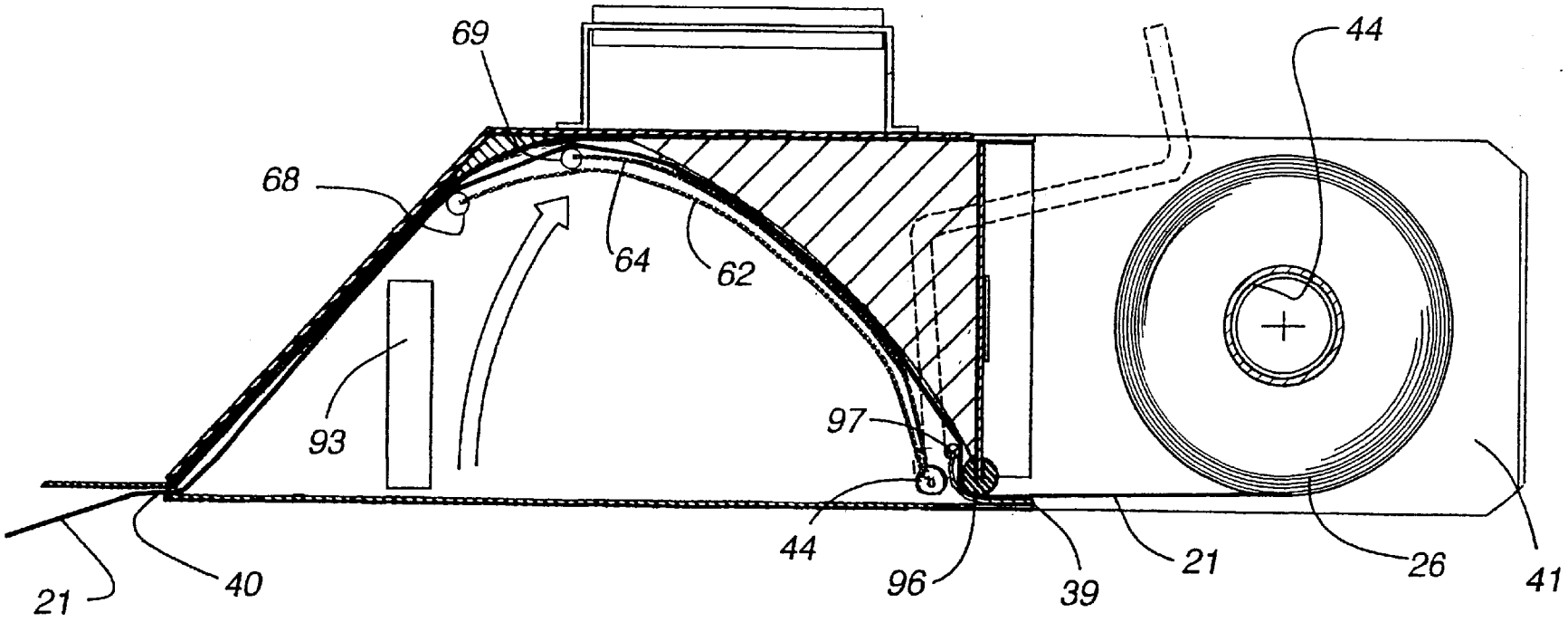
FIG. 13 is a view similar to FIG. 11 but showing the lifter in a further raised position.

This invention is an applicator tool or tape gun 20 for continuously coating drywall or wallboard joint tape 21 with joint compound 22, sometimes referred to as mastic or mud, and continuously applying the mud coated tape 21 to a joint 24 between two drywall panels 25. The tool contains both a supply of tape 21 conveniently provided on a roll or spool 26 supported on the tool, and a supply of joint compound or mud 22 in a chamber 28 defined in a box or housing 29 and through which tape 21 from the roll 26 is fed for the application of mud thereto and the subsequent application of the coated tape to a drywall joint 24.

The box for containing the joint compound 22 for application to the tape 21 is formed by a rear or back panel 30, a top panel or wall 31, a bottom panel or wall 32, a right side or end wall or panel 33, a sloping left side or end wall or panel 34, and a front panel or cover 35. The cover 35 is hinged or swingably mounted by a hinge 36 mounted along one edge of the cover 35 to a front panel 37 secured to the right side or end wall 33 and extending between the top wall 31 and bottom wall 32 of the housing 29. The cover 35 is releaseably secured to the left side wall 33 by a toggle or pull latch 38. The box 29 defines the interior chamber 28 for containing joint compound or mud 22 and including a tape entrance slot 39 through which joint tape 21 passes from the roll 26 into the chamber 28 for the application of mud 22 thereto, and a tape exit slot 40 through which coated tape 21 extends for application to a drywall joint 24.

A back panel extension 41 and a hinged panel 42 spaced apart and extending from the right side of the box support a shaft 44 therebetween, which shaft 44 in turn supports a roll or spool 26 of tape 21. The hinged panel 42 is supported by a hinge 45 at one edge to the box 29, and is releasably secured by a latch 46 at its other end to an end wall 48 extending forwardly from the back panel extension 41 to facilitate loading of the spool 26 of tape 21.

The box door or cover 35 includes side flanges or lips 49 extending rearwardly from the cover panel 35 for overlapping the side and end walls of the box to provide a seal to prevent leakage of joint compound from the chamber. Sealing strips 50 of rubber, felt or the like may be included between the side flanges 49 and the box walls.

The interior chamber 28 defined in the box 29 is defined by a bottom wall 51, a sloping front or left side wall 52, a curved upper and right side wall 54, the box back panel 30 and the cover panel or door 35. The sloping front wall and upper and right side wall together form an upper arcuate wall. Inserts 55, 56 having curved lower walls 57, 58, may be placed in the upper left and right corners 59, 60 respectively of the box 29 in order to define the upper curved wall 54 of the chamber 28.

In order to initially load the interior chamber 28 with tape 21 and joint compound or mud 22, the door panel 35 is opened and the tape 21 is manually pulled from the spool 26 and inserted through the entrance slot 39 and exit slot 40. The tape 21 is then raised or lifted upwardly against the upper curved surface or wall 54 of the chamber 28, and joint compound 22 is manually filled into the portion of the chamber space defined below the tape 21 and above the bottom wall 51 of the chamber 28. The door panel or cover 36 is closed and latched, and the tool is used to apply mud coated tape to a drywall joint 24 in the conventional manner by pulling the coated tape from the exit slot of the tool.

When the initial supply of mud 22 in the tool is exhausted, in accordance with the present invention the supply is replenished quickly and easily without opening the door panel or cover 35. To this end, in accordance with the present invention, the portion of the tape remaining in the chamber is lifted and positioned against the upper curved surface 54 and the front surface 52 of the chamber by a lifter mechanism 61, and joint compound 22 is supplied to the chamber below the tape 21 from a container or reservoir thereof (not shown).

The tape lifter mechanism 61 is formed by a lower elongated spring steel leaf 62 and an upper superimposed elongated spring plastic leaf 64, both secured at corresponding ends to a shaft 65 which extends between the box front and rear panels adjacent the entrance slot and is journaled on the panels for rotation by an operating handle or crank 66 exterior of the box and operatively connected thereto. At its end opposite from the shaft connection, each leaf spring is provided with a transverse cylindrical knob, nose or bobbin 68, 69 respectively for engaging and lifting the tape.

The lower lifter spring leaf 62 is formed of stiffly flexible steel or clock spring material. The upper lifter spring leaf 64 is formed of stiffly flexible plastic material and defines a pair of parallel longitudinal slots 70 therein that assist in preventing the wet tape from sticking to leaf 64.

The leaves are lifted to lift the tape in the chamber by swinging the handle in a clockwise direction, and retracted away from the tape by swinging the handle in the opposite direction. For engaging and holding the mud coated joint tape in the lifted position against the sloping front chamber wall 52 and curved upper chamber wall 54 for the replenishment of mud into the chamber after the lifter mechanism 61 is retracted, the upper front sloping wall 52 of the chamber is provided with an abrasive strip 71 which engages and grips the lifted tape 21. To this end, the lifter leaves 62, 64 lift and press the tape against the upper sloping chamber wall 52 so that the tape is retained against the wall. The tape is held in contact with the upper arcuate top wall surface 54 by the mud with which it is coated. The steel spring leaf 62 when rotated by the handle initially engages the tape and presses it against the chamber wall with sufficient force to cause the tape to stick to the abrasive strip or surface 71 on the wall 52. As the tape is lifted, the upper plastic leaf 64 lifts and presses the tape against the upper portion of the arcuate chamber wall 54 where it sticks until pulled free. The plastic leaf 64 is sufficiently flexible so that it gently lifts but does not tear the wet tape. The cylindrical nose 68, 69 on each leaf rides against the tape and further aids in preventing tearing of the wet tape 21.

A carrying handle 72 including a handle grip 73 secured to a handle bracket 74 is mounted on the top of the box. A side handle 75 formed by a flexible fabric strap 76 is secured at to the back side wall of the box. The latter handle is adjustable by an adjustment clamp 78 including a bracket 79, clamping plate 80 bolts 81 and wing nuts 82 securing the bracket 79 to the clamping plate 80.

An adjustable bracket 83 forming a dam plate 84 and cutter blade 85 is provided adjacent the exit slot 40 at the front of the tool. The bracket 83 is adjustably secured to the sloping front or left wall 34 of the tool by appropriate bolts 86 and wing nuts 88 and may be adjusted upwardly or downwardly to vary the width of the exit slot 40 and thereby control the amount of mud applied to the tape 21. The cutter blade 85 includes a sharp front edge 89 for cutting or tearing the tape 21 and appropriate finger slots 90, 91 for use by the tape installer for gripping the tape or pulling the tape manually through the chamber.

When periodically loading the chamber 28 with joint compound 22, the tape 21 extending through the exit slot 40 is gripped by the user through the central finger slot 90 in the cutter blade 85 to prevent withdrawal of the tape back into the chamber as it is lifted. The handle 66 is then rotated to cause the lifter leaves 62, 64 to lift the tape 21 above and away from the bottom wall 51 of the chamber 28 and into contact with the front sloping wall 52 and upper curved wall 54 of the chamber 28. The handle is then swung in the opposite direction to place the leaves 62, 64 against the bottom wall 51 of the chamber. At this point, the replenishment supply of mud is pumped into the chamber 28 through a valved port fitting 92 connected by a quick-connect connector fitting 95 to the mud reservoir (not shown). The port 92 is located between the lifter leaves 62, 64 and the raised tape. When the chamber 28 is full, as observed through a window 94 in the back wall panel 30 of the box 29, supply of the mud to the chamber is stopped and the gun is disconnected from the supply reservoir. The fitting desirably includes an interior anti-backflow valve to prevent joint compound from leaking through the filling port when the tool is in use. Alternatively, after lifting the tape, joint compound can be supplied to the chamber 28 by opening the cover 35 and manually filling the chamber with compound.

When loading the tool with tape and joint compound, tape 21 is fed from the roll or spool 26 thereof through the entrance slot 39 and under a tape guide 96 defining the upper edge of the entrance slot 39. To facilitate feeding of the tape 21 into the chamber 28, an adjustable width tape entrance throat or slot 39 is provided by mounting the entrance tape guide cylinder or bobbin 96 on a plate 98 which is adjustably secured to the end wall 33 of the housing by releasable fasteners such as bolts 99 and wing nuts 100 or their equivalents. By loosening the wing nuts 100, the cylinder 96 can be moved toward or away from the base or bottom wall or panel 32 of the housing 29 to reduce or enlarge the entrance slot 39.

From the entrance tape guide cylinder 96, the tape is fed over an idler cylinder or guide 101 into the chamber 28 and out through the exit slot 40. The idler cylinder 101 is supported on an arcuate, stiffly flexible, panel 102 carrying the idler on one edge and secured adjacent its other edge to the bottom panel 32 of the housing 29.

The action of the tape lifter 61 and lifter leaves 62, 64 is illustrated in FIGS. 14A–H, which figures show the sequence of movement and positions of the lifter leaves 62, 64 as the handle 66 is swung clockwise to lift the tape 21 and counter-clockwise to lower the lifter leaves 62, 64, leaving the tape 21 in raised position and the chamber 28 ready to receive a supply of joint compound.

Figure 14A:
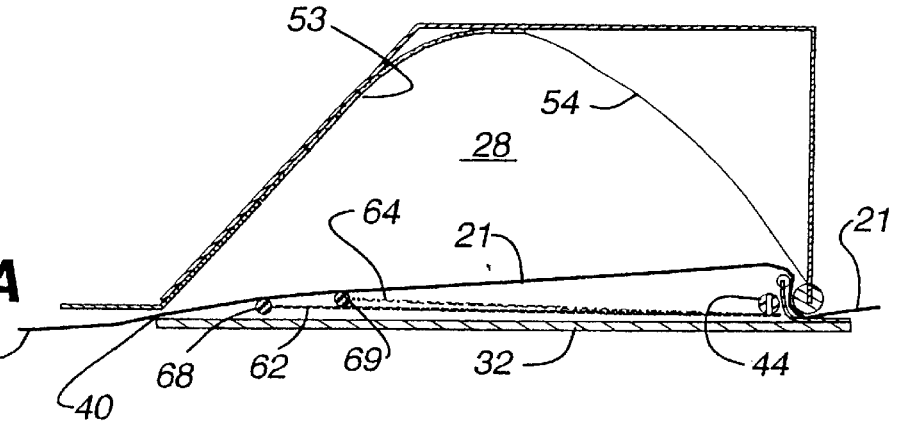
FIGS. 14A–D are a diagrammatic series of illustrations showing the lifting of the tape by the tape lifter.
Figure 14B:
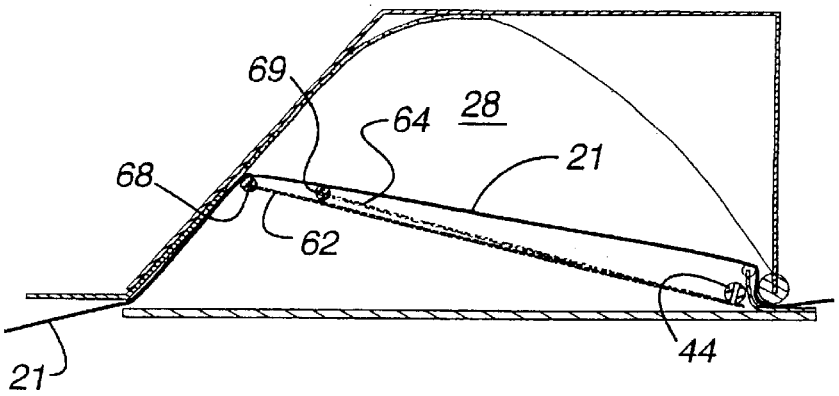

As shown schematically in FIG. 14A, the lifter springs 62, 64 initially lie adjacent the bottom panel 32 of the housing 29 with the plastic spring leaf 64 on top of the steel spring leaf 62 and the cylinder or bobbin 69 of the upper plastic leaf 64 lying behind the cylinder or bobbin 68 of the lower leaf 62. As the handle 66 is swung further forward or clockwise as shown in FIG. 14B, The wet tape is lifted away from the bottom panel 32. The nose 68 of the lower lifter leaf 62 presses the tape against the abrasive surface 71 of the sloping wall 52, while the nose 69 of the upper leaf 64 lifts the tape 21.

Figure 14C:
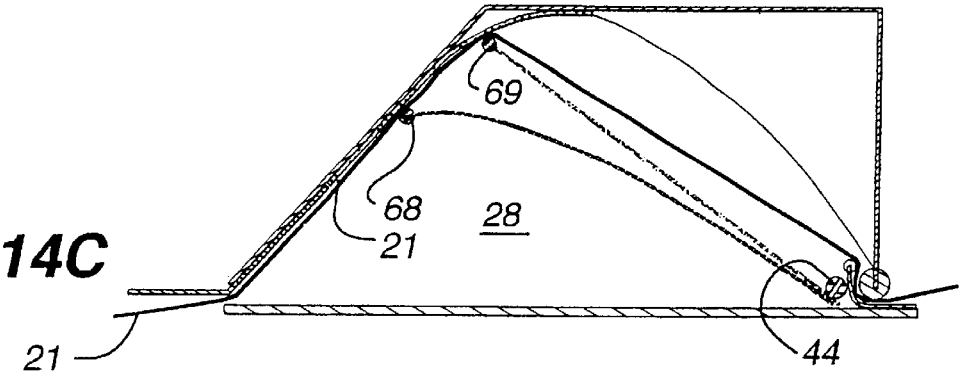

Further rotation of the handle 66 as shown in FIG. 14C raises the leaves 62, 64 with the nose 68 of the lower leaf sliding upon and along the tape 21 to press the tape against the sloping abrasive surface and causing the lower leaf to bow slightly. The nose of the upper leaf 64 further lifts the tape away from the lower leaf and positions it against the upper curved surface 54.

Figure 14D:
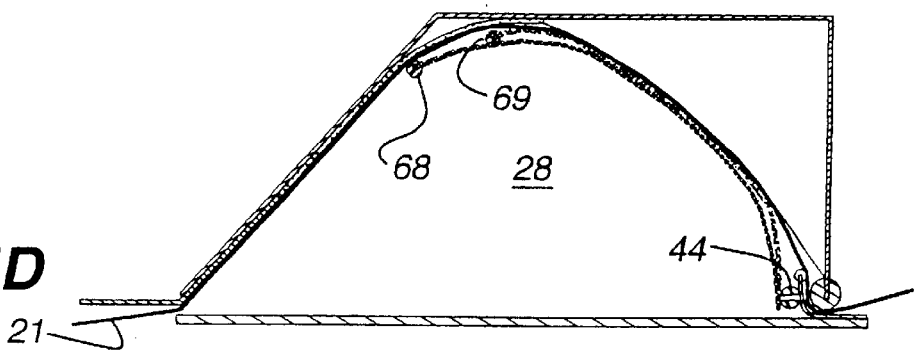

As the lifter is further raised by rotating the handle, as shown in FIG. 14D, the nose 68 of the lower leaf 62 holds the tape against the abrasive front sloping surface 71 while the upper leaf bows to engage and press the wet tape 21 against the upper curved surface 54, to which it adheres because of the mud with which is coated. At this point, as shown in FIG. 14D, the tape is fully lifted. It should be noted that the upper leaf 64 bows and presses the tape along its length against the upper curved surface.

Figure 15A:
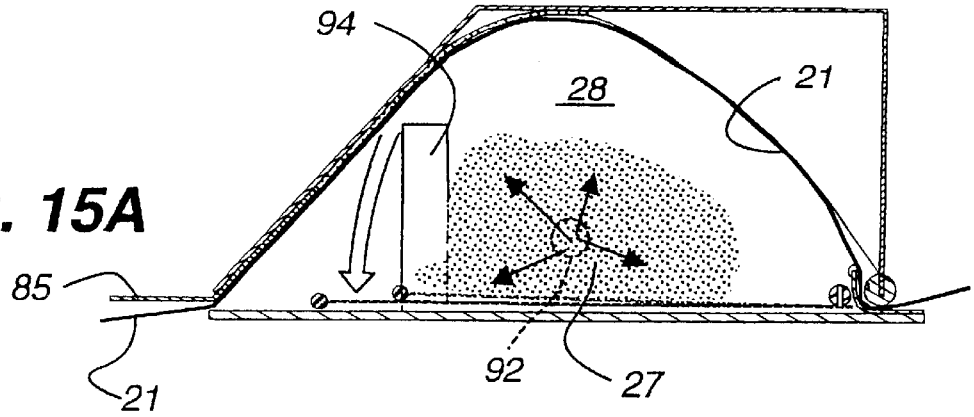
FIGS. 15A–D are a diagrammatic series of illustrations showing retracting of the lifter, loading of the joint compound and application of the tape and joint compound to the wallboard joint.
Figure 15B:
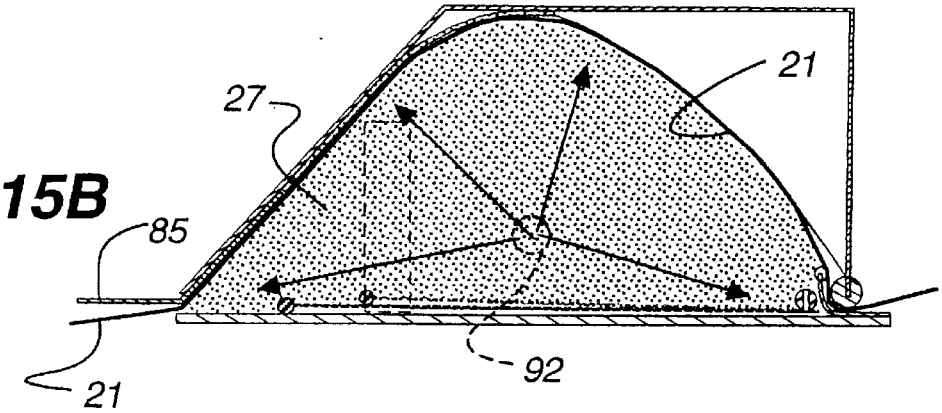

With the tape lying against the abrasive surface and upper curved surface, the direction of movement of the handle 66 is reversed and the handle swung in a counterclockwise direction. As shown in FIG. 15A, the leaves 62, 64 drop away from the tape 21 which adheres to the upper curved surface 54. The slots in the upper leaf help prevent the leaf from pulling the tape away from the curved surface. Counterclockwise rotation of the handle 66 positions the leaves 62, 64 together in their original position adjacent the lower housing wall 32, leaving the tape stuck to the sloping surface and upper curved surface of the chamber. At this point joint compound can be introduced into the chamber as shown in FIG. 15B between the lower wall 32 and lifter 61 at the bottom, and the tape 21 at the top of the chamber.

Figure 15C:
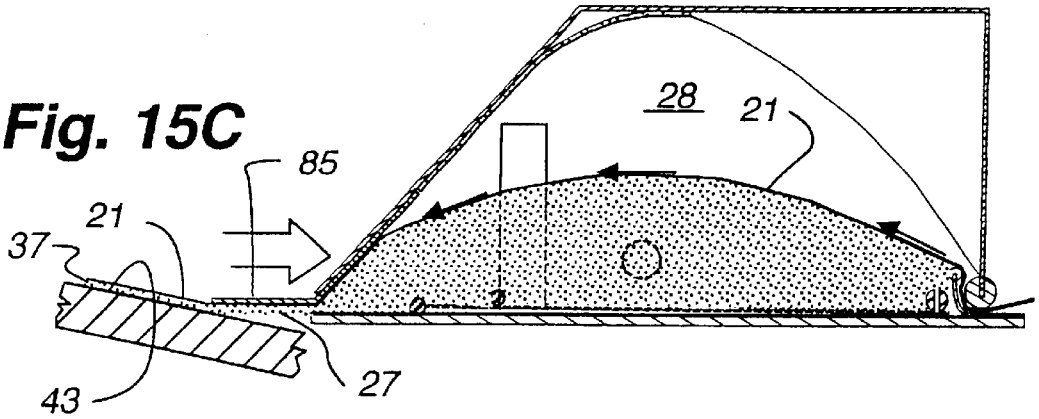
Figure 15D:
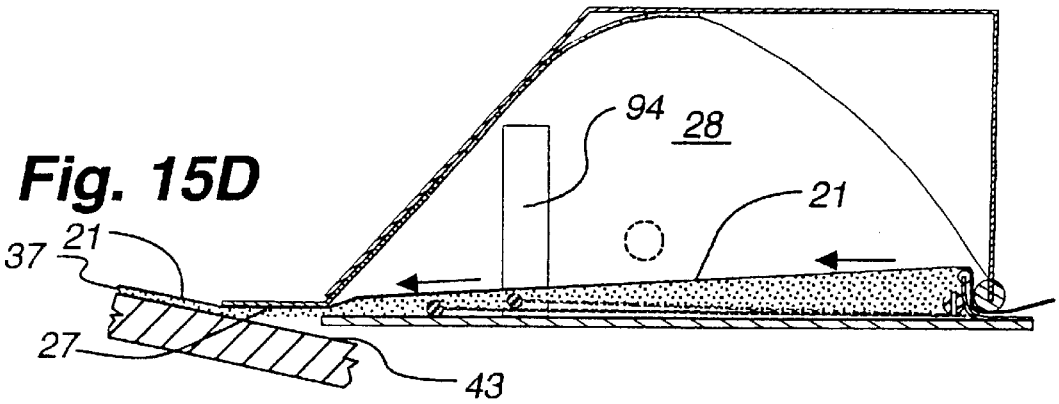

As the drywall tape installer applies tape and joint compound 37 to a drywall joint 43, the tape is continuously coated with the joint compound 27 as shown in FIG. 15C. When the joint compound in the compound chamber has been substantially depleted, as shown in FIG. 15D, it is a simple matter for the user to swing the handle to lift the tape, then swing the handle back to lower the tape lifter to a position against the bottom wall of the chamber, connect the chamber input port to a mud supply through a quick connect connector, or open the front cover, and refill the chamber with joint compound. Taping of the wall joints is continued and this process is repeated until the drywall application is complete. With the taping tool embodying the present invention, the burdensome task of loading the tool with joint compound is substantially relieved, the speed of the taping work is increased, waste of joint compound is reduced, tearing or jamming of the tape is avoided, and physical contact of the user with the compound reduced thereby leading to cleanliness of the work area and less need for clean-up.

While a certain illustrative embodiment of the present invention has been shown in the drawings and described above in detail, it should be understood that there is no intention to limit the invention to the specific form disclosed. On the contrary the intention is to cover modifications, alternative constructions, equivalents, and uses falling within the spirit and scope of the invention as expressed in the appended claims.

What is claimed is:

1. A tape gun for applying joint tape and joint compound to drywall joints comprising:

a housing having opposed side walls spaced apart a width determined by the width of the tape being applied, and peripheral top, bottom, and end walls;

said housing defining therein a chamber for holding said joint compound for application to said tape;

said housing further defining an entrance slot in one end wall opening into said chamber for receiving tape for the application of joint compound thereto and an exit slot for supplying tape with joint compound thereon to the drywall joint;

said chamber having an upper arcuate top wall and a lower elongated bottom wall;

a tape lifter swingably mounted in said housing and extending into said chamber between said tape entrance slot and said tape exit slot and positioned adjacent the lower chamber wall with the tape positioned between said lifter and the upper wall of said chamber;

a handle swingably mounted exteriorly on said housing and operatively connected to said tape lifter for swinging said tape lifter to lift said tape and position said tape against the upper wall of said chamber, and for retracting said lifter to position the same adjacent the bottom wall of said chamber; and said housing further defining in one wall a valved port through which joint compound is introduced into said chamber below said lifted tape;

whereby joint compound can be supplied to said chamber through said port and below said tape for subsequent application to said tape as said tape passes through said slots for application to drywall joints.

2. A tape gun as defined in claim 1 wherein said lifter comprises a pair of elongated, stiffly flexible leaves superimposed one on the other and each operatively connected at one end to said lifting handle.

3. A tape gun as defined in claim 2 wherein the uppermost leaf is shorter than the lowermost leaf.

4. A tape gun as defined in claim 3 wherein said lowermost leaf is spring steel.

5. A tape gun as defined in claim 4 wherein said leaf is coated with a smooth plastic material.

6. A tape gun as defined in claim 2 wherein said uppermost leaf is stiffly flexible plastic.

7. A tape gun as defined in claim 6 wherein said leaf defines elongated spaced parallel slots.

8. A tape gun as defined in claim 2 wherein each leaf includes a cylindrical nose on the free end thereof for engaging the tape.

9. A tape gun as defined in claim 1 further comprising a rough surface on a portion of the upper arcuate curved wall.

10. A tape and joint compound dispenser comprising a housing defining an interior chamber for receiving joint compound and joint tape; and a tape lifter in said chamber; whereby said tape in said chamber is lifted to facilitate supplying joint compound to said chamber below said tape.

11. A tape and joint compound dispenser as defined in claim 10 further comprising a handle exterior of said housing and operatively connected to said tape lifter.

12. A tape and joint compound dispenser as defined in claim 11 further comprising a shaft journaled in said housing and operatively connected to said tape lifter and said handle.

13. A tape and joint compound dispenser as defined in claim 10 wherein said lifter comprises a pair of stiffly flexible elongated leaf springs.

14. A tape and joint compound dispenser as defined in claim 13 wherein one of said leaves is spring metal and the other is spring plastic.

15. A tape and joint compound dispenser as defined in claim 14 wherein said metal leaf is coated with plastic.

16. A tape and joint compound dispenser as defined in claim 14 wherein sail metal leaf is longer than said plastic leaf.

17. A tape and joint compound dispenser as defined in claim 12 wherein said lifter comprises a pair of stiffly flexible elongated leaf springs each attached at one end to said shaft.

18. A tape and joint compound dispenser as defined in claim 17 wherein a nose defining an arcuate surface is provided on the end of each elongated leaf spring opposite to the end thereof attached to said shaft.

19. A tape and joint compound dispenser as defined in claim 18 wherein said nose surface is smooth and non-abrasive.

20. A tape and joint compound dispenser comprising a housing defining an interior chamber for receiving joint compound and joint tape; a valved port in said housing opening into said chamber; and a tape lifter in said chamber; whereby said tape in said chamber is lifted to facilitate supplying joint compound to said chamber through said port and below said tape.

* * * * *